US011066769B2

(12) United States Patent
Yano et al.

(10) Patent No.: US 11,066,769 B2
(45) Date of Patent: Jul. 20, 2021

(54) CLOTH SPREADING APPARATUS

(71) Applicant: PUREX CO., LTD., Takamatsu (JP)

(72) Inventors: Makoto Yano, Takamatsu (JP); Hiroyuki Ideue, Takamatsu (JP)

(73) Assignee: PUREX CO., LTD., Takamatsu (JP)

( * ) Notice: Subject to any disclaimer, the term of this patent is extended or adjusted under 35 U.S.C. 154(b) by 175 days.

(21) Appl. No.: 16/482,386

(22) PCT Filed: Jan. 29, 2018

(86) PCT No.: PCT/JP2018/002756
§ 371 (c)(1),
(2) Date: Jul. 31, 2019

(87) PCT Pub. No.: WO2018/143128
PCT Pub. Date: Aug. 9, 2018

(65) Prior Publication Data

US 2020/0002865 A1 Jan. 2, 2020

(30) Foreign Application Priority Data

Jan. 31, 2017 (JP) ..... JP2017-015723
Jan. 12, 2018 (JP) ..... JP2018-003637

(51) Int. Cl.
*D06C 3/00* (2006.01)
*D06F 67/04* (2006.01)
*D06F 67/02* (2006.01)

(52) U.S. Cl.
CPC ..... *D06C 3/00* (2013.01); *D06F 67/04* (2013.01); *D06F 67/02* (2013.01)

(58) Field of Classification Search
CPC . D06C 3/00; D06F 67/00; D06F 67/02; D06F 67/04; D06F 67/10
See application file for complete search history.

(56) References Cited

U.S. PATENT DOCUMENTS 4,774,505 A * 9/1988 Ueda ..... B61B 10/025 198/464.3
5,168,645 A * 12/1992 Robin ..... D06F 95/00 38/143

(Continued)

FOREIGN PATENT DOCUMENTS

EP 0272368 A1 6/1988
JP H05-293299 A 11/1993

(Continued)

OTHER PUBLICATIONS

Dec. 6, 2019 Search Report issued in European Patent Application No. 18747243.6.

(Continued)

*Primary Examiner* — Ismael Izaguirre
(74) *Attorney, Agent, or Firm* — Oliff PLC

(57) ABSTRACT

A cloth spreading apparatus is capable of eliminating the troublesome work of pulling a cloth when the cloth is held by feeding chucks to reduce burden of the worker and operation time. A cloth spreading apparatus includes a pair of feeding chucks grasping adjacent corners of a cloth, a moving device for moving the pair of feeding chucks between a feeding position and a delivery position of the cloth to draw the cloth, and spreading chucks for receiving the cloth directly or indirectly from the pair of feeding chucks and spreading the cloth in a direction of separating the adjacent corners from each other. The moving device has separate moving trajectories corresponding to the respective feeding chucks so that the pair of feeding chucks can move between the feeding position and the delivery position independently of each other.

20 Claims, 8 Drawing Sheets

(56) References Cited

U.S. PATENT DOCUMENTS

| | | | | | |
|---|---|---|---|---|---|
| 5,169,282 | A * | 12/1992 | Ueda | D06F 67/04 | 38/7 |
| 5,515,627 | A * | 5/1996 | McCabe | D06F 67/04 | 38/143 |
| 6,533,267 | B1 * | 3/2003 | Muessig | A41H 43/0264 | 112/306 |
| 7,401,426 | B2 * | 7/2008 | Nielsen | D06F 67/04 | 38/143 |
| 2017/0204555 | A1 | 7/2017 | Tanii | | |

FOREIGN PATENT DOCUMENTS

| | | | |
|---|---|---|---|
| JP | 2010-024552 | A | 2/2010 |
| JP | 2013-172856 | A | 9/2013 |
| JP | 2016-033271 | A | 3/2016 |

OTHER PUBLICATIONS

May 1, 2018 Search Report issued in International Patent Application No. PCT/JP2018/002756.

* cited by examiner

CLOTH SPREADING APPARATUS

TECHNICAL FIELD

The present invention relates to a cloth spreading apparatus used when pieces of cloth such as sheets, towels and so on washed in a cloth washing factory or the like are spread one by one for feeding into an iron roller (also called a roll ironer).

BACKGROUND ART

As the conventional cloth spreading apparatus is known, for example, one described in Patent Literature 1, which has been previously disclosed by the present applicant. This cloth spreading apparatus comprises a cloth feeding unit and a spreading unit for spreading the cloth from side to side. The feeding unit has a pair of feeding chucks grasping adjacent corners of the cloth at a descending position (feeding position), and a lifting device moving the pair of feeding chucks up and down. The spreading unit has a pair of spreading chucks receiving the cloth from the feeding chucks at a raised position (delivery position) of the pair of feeding chucks and grasping the adjacent corners of the cloth, and a traversing device traversing the pair of spreading chucks to spread the cloth in a horizontal direction.

An action of spreading the washed cloth with such a cloth spreading apparatus will be described with reference to FIG. 8. First, a pair of feeding chucks 122 are waiting at a lower feeding position. In this state, as shown in FIG. 8(*a*), one corner Ca of adjacent corners Ca and Cb of a cloth C is first grasped with one of the feeding chucks 122 by a worker. Next, as shown in FIG. 8(*b*), the worker pulls the corner Cb of the cloth C at a state of grasping the corner Ca with the feeding chuck 122, and thereafter the corner Cb is grasped with the feeding chuck 122. Then, the worker presses a switch button, whereby both feeding chucks 122 are lifted together upward from the feeding position toward the delivery position of spreading chucks 142 as shown in FIG. 8(*c*). When the feeding chucks 122 arrive at the delivery position as shown in FIG. 8(*d*), the corners Ca and Cb of the cloth C are delivered from the feeding chucks 122 to the respective spreading chucks 142. Thereafter, as shown in FIG. 8(*e*), a traversing device 148 is moved so as to separate the pair of spreading chucks 142 from each other in the horizontal direction, whereby the cloth C is spread in the horizontal direction. In this period, the pair of feeding chucks 122 return to the original lower position to become ready for receiving the next cloth C to be fed.

CITATION LIST

Patent Literature

Patent Literature 1: JP-A-2016-33271

SUMMARY OF INVENTION

Technical Problem

In the conventional cloth spreading apparatus, however, there is a problem that when the cloth is grasped by the pair of feeding chucks, it is required to conduct complicated operation that one of the adjacent corners of the cloth is grasped with one of the feeding chucks and thereafter the other corner is found while pulling. Especially when pieces of cloth with a large side length such as sheets are fed, great amounts of effort and time are taken in the pulling of the other corner and hence the feeding operation of the cloth is poor.

An object of the present invention is to solve the problem of the above conventional art and provide a cloth spreading apparatus which is excellent in the feeding operation and is capable of lessening burden of the worker and reducing operation time.

Solution to Problem

The present invention lies in a cloth spreading apparatus comprising a pair of feeding chucks for grasping adjacent corners of a cloth, a moving device for moving the pair of feeding chucks between a feeding position and a delivery position of the cloth to feed the cloth, and a spreading chuck for directly or indirectly receiving the cloth from the pair of feeding chucks and spreading the cloth in a direction of separating the adjacent corners from each other, wherein the moving device has a separate moving trajectory corresponding to each of the feeding chucks and the pair of feeding chucks are constructed so as to be moved independently of each other between the feeding position and the delivery position.

In the cloth spreading apparatus according to the present invention, it is preferable that one feeding chuck in the pair of feeding chucks moves toward the delivery position earlier than the other feeding chuck.

In the cloth spreading apparatus according to the present invention, it is preferable that a distance that the former feeding chuck moves toward the delivery position earlier than the latter feeding chuck can be set arbitrarily.

In the cloth spreading apparatus according to the present invention, it is preferable that a distance that the former feeding chuck moves toward the delivery position earlier than the latter feeding chuck can be set stepwise.

In the cloth spreading apparatus according to the present invention, it is preferable that the pair of feeding chucks move at a synchronous speed to each other toward the delivery position in a state of grasping the cloth with the pair of feeding chucks.

Alternatively, it is preferable in the cloth spreading apparatus according to the present invention that the latter feeding chuck that departed later moves toward the delivery position at a speed faster than that of the former feeding chuck that departed earlier in a state of grasping the cloth with the pair of feeding chucks.

In the cloth spreading apparatus according to the present invention, it is preferable that the former feeding chuck that departed earlier toward the delivery position performs the delivery of the cloth to the spreading chuck earlier than the latter feeding chuck that departed later, and returns to an original feeding position earlier than the latter feeding chuck after the completion of the delivery.

Effect of the Invention

In the cloth spreading apparatus according to the present invention, the pair of feeding chucks can move between the feeding position and the delivery position independently of each other. Thus, when one of the feeding chucks grasps one of the adjacent corners of cloth and is moved toward the delivery position earlier than the other feeding chuck, the other corner of cloth to be grasped by the other feeding chuck appears near the feeding position, and hence the cumbersome operation of finding the other corner while pulling by the worker can be made unnecessary to perform the feeding work easily.

When it is configured that the former feeding chuck in the pair of feeding chucks moves toward the delivery position earlier than the latter feeding chuck, the excellent feeding workability can be obtained more reliably.

When it is configured that the distance (earlier moving distance) that the former feeding chuck moves toward the delivery position earlier than the latter feeding chuck can be set arbitrarily, the apparatus can be easily adapted to cloths having different sizes by changing the earlier moving distance in accordance with the size of the cloth to be fed.

Further, when it is configured that the distance that the former feeding chuck moves toward the delivery position earlier than the latter feeding chuck can be set stepwise, the earlier moving distance can be easily changed in the feeding of cloths having different sizes.

Moreover, when it is configured that the pair of feeding chucks move toward the delivery position at a synchronous speed to each other in a state of grasping the cloth with the pair of feeding chucks, the relative distance between the pair of feeding chucks during the moving can be kept constant to prevent application of an unnecessary tensile force to the cloth.

Also, when it is configured that, in the state where the pair of feeding chucks both grasp the cloth, the latter feeding chuck that departed later moves toward the delivery position at a speed faster than that of the former feeding chuck that departed earlier, it is possible not only to prevent application of an unnecessary tensile force to the moving cloth, but also to shorten a time for delivering the cloth to the spreading unit with the latter feeding chuck to increase the working efficiency.

Furthermore, when it is configured that the former feeding chuck that departed earlier toward the delivery position performs the delivery of the cloth to the spreading chuck previous to the latter feeding chuck that departed later and returns to the original feeding position previous to the latter feeding chuck after the completion of the delivery, a time for returning the former feeding chuck to the original feeding position to attain a state of waiting the next feeding can be shortened to further increase the working efficiency.

DESCRIPTION OF EMBODIMENTS

Figure 1:
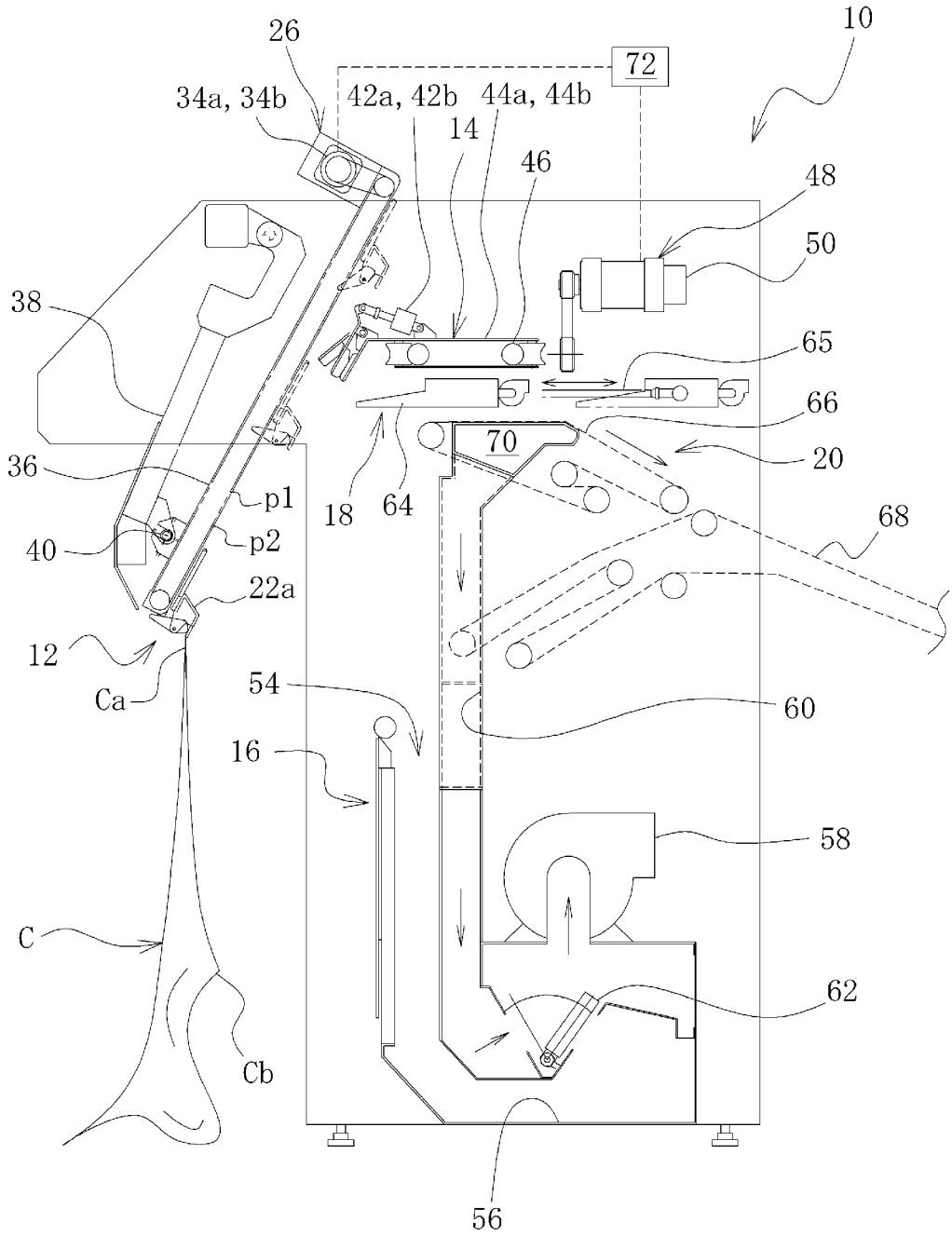
FIG. 1 is a sectional view of a cloth spreading apparatus according to an embodiment of the present invention taken along a front-back direction thereof.
Figure 2:
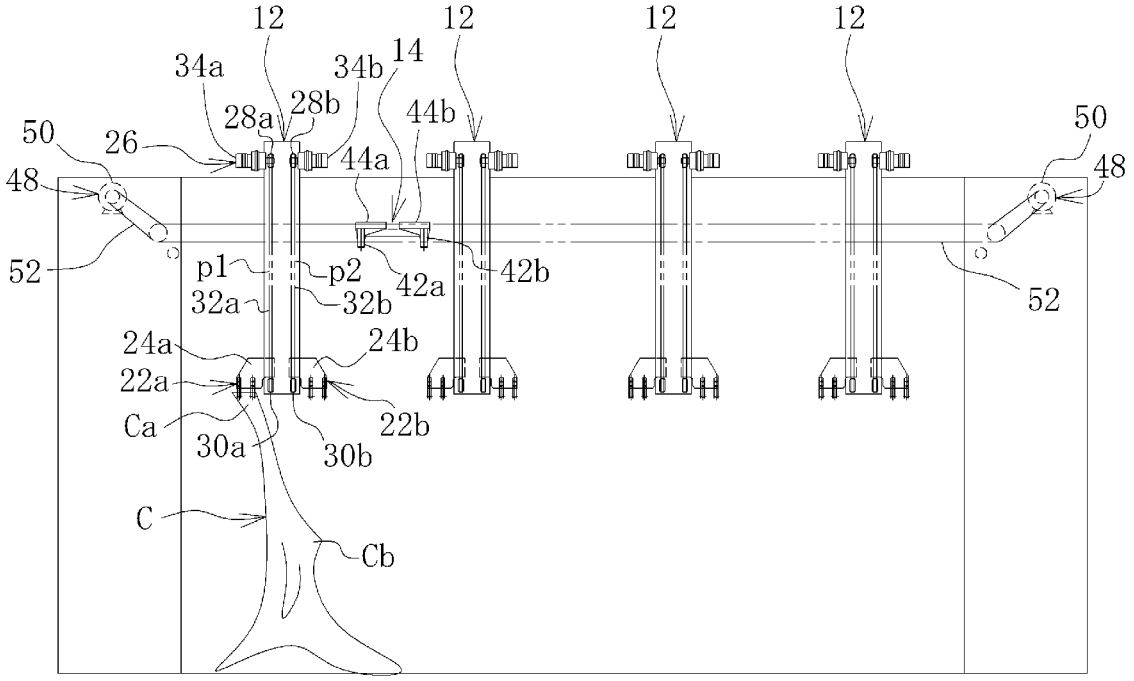
FIG. 2 is a front view of the cloth spreading apparatus of FIG. 1.
Figure 3:
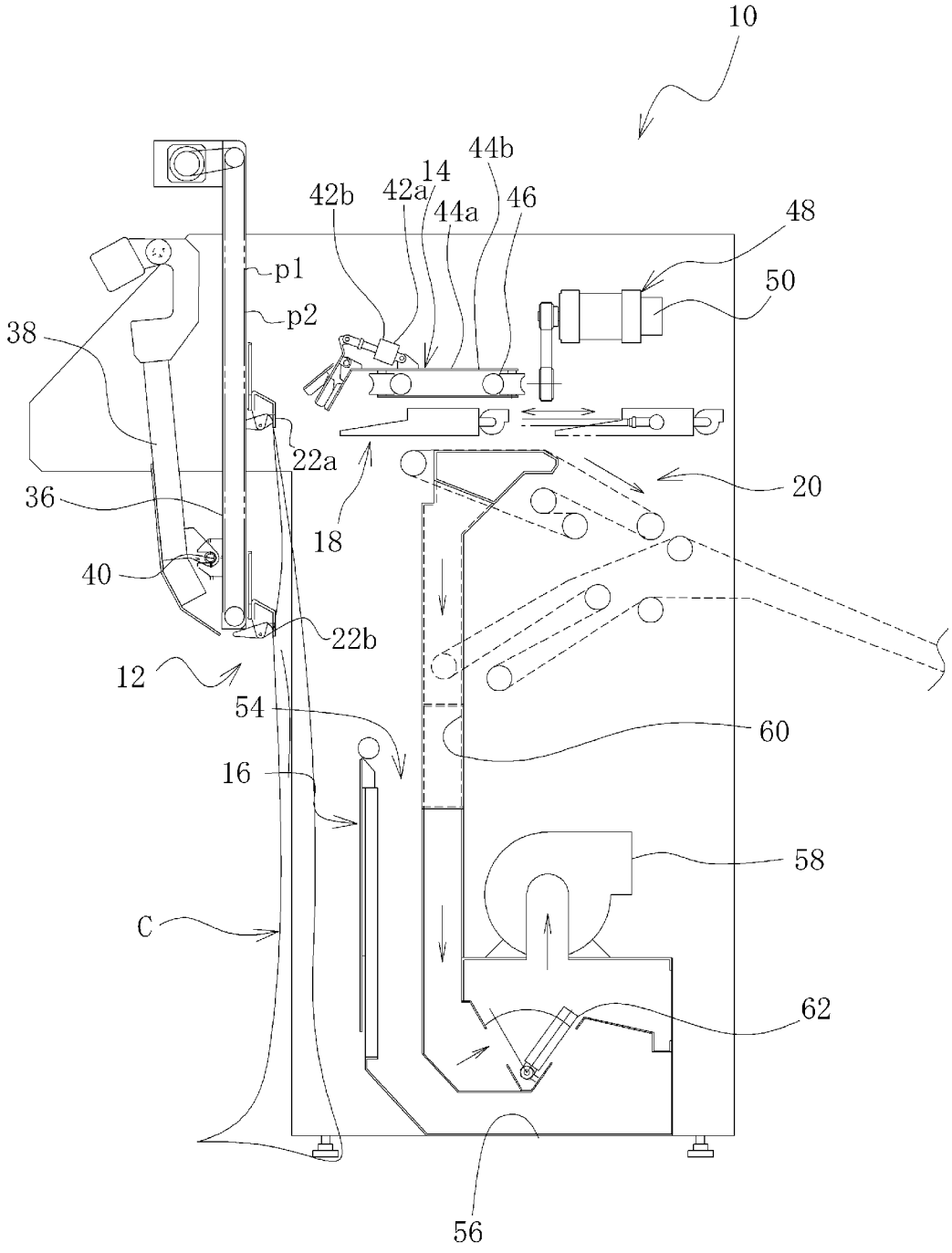
FIG. 3 is a sectional view showing a state of changing first and second moving trajectories of the cloth spreading apparatus of FIG. 1 to a vertical posture.

An embodiment of the present invention will be described in detail with reference to the drawings below. Here, FIG. 1 is a sectional view of a cloth spreading apparatus according to an embodiment of the present invention taken along a front-back direction. FIG. 2 is a front view of the cloth spreading apparatus. FIG. 3 is a sectional view showing a state of changing first and second moving trajectories of the cloth spreading apparatus to a vertical posture.

The cloth spreading apparatus 10 is an apparatus for hanging a cloth C at a state of shaping and stretching into a quadrangular form and then feeding into a roll ironer or the like as a treating device for the next process. The cloth C handled by the cloth spreading apparatus 10 is a piece after the washing and drying and before the ironing and has a quadrangular form. The quadrangular form includes a square form and a rectangular form. Moreover, the cloth C may include sheets, bedding covers, towels and so on.

As shown in FIG. 1, the cloth spreading apparatus 10 comprises a feeding unit 12 for delivering the cloth C from a lower feeding position to a predetermined height position (delivery position) while holding adjacent corners Ca and Cb thereof and drawing the cloth C into the cloth spreading apparatus 10, a spreading unit 14 for receiving the adjacent corners Ca and Cb of the cloth C delivered to the predetermined height position by the feeding unit 12 and spreading in a horizontal direction of separating the corners Ca and Cb from each other, a suction unit 16 disposed immediately below the spreading unit 14 and sucking a lower part of the cloth C spread in the horizontal direction by the spreading unit 14 and spreading into an up-down direction, a forwarding unit 18 for forwarding the cloth C spread in four directions by the spreading unit 14 and the suction unit 16, and a transfer unit 20 for receiving the cloth C from the forwarding unit 18 and transferring to a treating device for the next process (a roll ironer or the like).

In this embodiment, four feeding units 12 are arranged side by side in the horizontal direction as shown in FIG. 2, but the number of the feeding units 12 is not limited to this example. Each of the feeding units 12 is disposed on a front face of the cloth spreading apparatus 10. The feeding unit 12 has a pair of left and right feeding chucks (hereinafter also referred to as first and second feeding chucks) 22*a* and 22*b* disposed at an interval equivalent to a shoulder width of a person. The feeding chucks 22*a* and 22*b* are fixed to a pair of left and right chuck bases (hereinafter also referred to as first and second chuck bases) 24*a* and 24*b*. Each of the feeding chucks 22*a* and 22*b* has, for example, two chuck portions (claws) disposed at a small interval in the horizontal direction to each other for switching, for example, the holding and releasing of the cloth C. The switching operation of the chuck portions can be conducted by using an electric actuator, an air pressure or the like. Also, each of the feeding chucks 22*a* and 22*b* may have a sensor for detecting the grasping of the cloth C.

The feeding unit 12 also comprises a moving device 26 that moves the first and second feeding chucks 22*a* and 22*b* from the feeding position to the delivery position to draw the cloth C into the apparatus. The moving device 26 has separate moving trajectories (hereinafter also referred to as first and second moving trajectories) p1 and p2 corresponding to the first and second feeding chucks 22*a* and 22*b*. Each of the moving trajectories p1 and p2 is defined by a linear trajectory (guide rails; not shown).

In the illustrated example, the moving device 26 comprises a first endless belt 32*a* wound between a first driving shaft 28*a* and a first driven shaft 30*a* along the first moving trajectory p1 and provided with a first chuck base 24*a* mounted on a circumference thereof, a first motor 34*a* rotating the first driving shaft 28*a*, a second endless belt 32*b* wound between a second driving shaft 28*b* and a second driven shaft 30*b* along the second moving trajectory p2 and provided with a second chuck base 24*b* mounted on a circumference thereof, and a second motor 34*b* rotating the second driving shaft 28*b*. As the first and second motors 34*a* and 34*b* can be used a servomotor or a stepping motor capable of controlling the speed and position of the first and second feeding chucks 22*a* and 22*b*. According to this configuration, the first and second feeding chucks 22*a* and 22*b* can be reciprocated (lifted) independently of each other between the feeding position and the delivery position along the first and second moving trajectories p1 and p2 by separately rotating the first and second driving shafts 28*a* and 28*b* in normal and reverse directions. Alternatively, a loop track may be used as mentioned later to move (raise) the first and second feeding chucks 22*a* and 22*b* to the delivery position, and then move (lower) the first and second feeding chucks 22*a* and 22*b* to the feeding position by rotating the first and second driving shafts 28*a* and 28*b* in the normal direction to turn the first and second feeding chucks 22*a* and 22*b*.

A moving device 26 in another example (not shown) comprises a single motor capable of controlling speed and position instead of the first and second motors 34*a* and 34*b*, a first clutch for transmitting or interrupting rotation between the motor and the first driving shaft 28*a* under control, and a second clutch for transmitting or interrupting rotation between the motor and the second driving shaft 28*b* under control. Even in such a configuration, it is possible to move the first and second feeding chucks 22*a* and 22*b* independently of each other by controlling the timing of engaging the first and second clutches.

A moving device 26 in further another example (not shown) comprises the first and second electric linear actuators or first and second air cylinders (e.g., rod-less cylinders) for moving the first and second feeding chucks 22*a* and 22*b* independently of each other along the first and second moving trajectories p1 and p2.

As shown in FIG. 1, the feeding unit 12 is pivotally supported at a lower position of a frame 36 by a support arm 38 through a shaft 40. The support arm 38 can be swung back and forth by a swinging device (not shown), whereby a backward inclined posture of the first and second moving trajectories p1 and p2 as shown in the side view of FIG. 1 and a vertical posture of the first and second moving trajectories p1 and p2 as shown in the side view of FIG. 3 can be taken.

As shown in FIG. 2, the spreading unit 14 comprises a pair of left and right spreading chucks (hereinafter also referred to as first and second spreading chucks) 42*a* and 42*b* for receiving the corners Ca and Cb at both ends in one side of the cloth C held by the first and second feeding chucks 22*a* and 22*b*. Each of the spreading chucks 42*a* and 42*b* may have one chuck portion capable of moving into and out of a clearance between the two chuck portions of the feeding chucks 22*a* and 22*b*. The chuck portions of the spreading chucks 42*a* and 42*b* can be opened and closed by using an electric actuator, air pressure or the like the chuck portions of the feeding chucks 22*a* and 22*b*.

As shown in FIGS. 1 and 2, the spreading unit 14 further comprises a pair of carriages 44*a* and 44*b* fixed to the spreading chucks 42*a* and 42*b*, respectively, rails 46 for guiding the carriages 44*a* and 44*b* so as to move rightward and leftward and a traversing device 48 capable of separately moving the carriages 44*a* and 44*b*. The traversing device 48 is constructed, for example, by a combination of a servomotor 50 and an endless belt 52. The pair of spreading chucks 42*a* and 42*b* can be traversed separately by the traversing device 48. Moreover, the traversing device 48 is not limited to the servomotor, and can be driven by another actuator capable of controlling speed and position.

The suction unit 16 is provided at a front lower part of the apparatus 10 with a suction introduction passage 54 for taking a lower part of the cloth C held by the spreading unit 14 by suction. A lower end of the suction introduction passage 54 is connected to a suction fan 58 through a lower duct 56. A vertical duct 60 extending in the up-down direction is formed in the back face of the suction introduction passage 54. A flow path switching plate 62 is provided between the lower duct 56, the vertical duct 60 and the suction fan 58. The flow path switching plate 62 is constructed so as to selectively communicate an opening of the lower duct 56 or an opening of the vertical duct 60 to the suction fan 58.

The forwarding unit 18 is disposed between the spreading unit 14, and the transfer unit 20 and receives the cloth C from the spreading unit 14 and delivers the cloth C to the transfer unit 20. The forwarding unit 18 includes a vacuum box 64 for holding the upper edge of the cloth C by suction under the action of negative pressure, and an air cylinder, a servomotor or the like as an advance/retract means 65 for advancing and retracting the vacuum box 64 in the front-rear direction.

The transfer unit 20 comprises a primary belt conveyor 66 for receiving the cloth C in a spreading state from the spreading unit 14 through the forwarding unit 18 and a secondary belt conveyor 68 disposed on the rear thereof. The primary belt conveyor 66 has a large number of small holes on its conveying surface. On the back side of the conveying surface of the primary belt conveyor 66 is disposed a vacuum box 70 connected to the suction fan 58 through the vertical duct 60. The opening of the vertical duct 60 is opened by the flow path switching plate 62 to render the vacuum box 70 into a negative pressure, whereby the cloth C is delivered backward by the primary belt conveyor 66 while suctioning. The secondary belt conveyor 68 can deliver the cloth C into the processing device for the next process such as a roll ironer.

The cloth spreading apparatus 10 further comprises a control device 72 for controlling the operation of the moving device 26 and the traversing device 48. The control device 72 is a computer comprised of a CPU, a memory and so on. It is possible to synchronously move the feeding chucks 22*a* and 22*b* and the spreading chucks 42*a* and 42*b* by controlling the operation of the moving device 26 and the traversing device 48 through the control device 72. This will be described in detail later.

Figure 4:
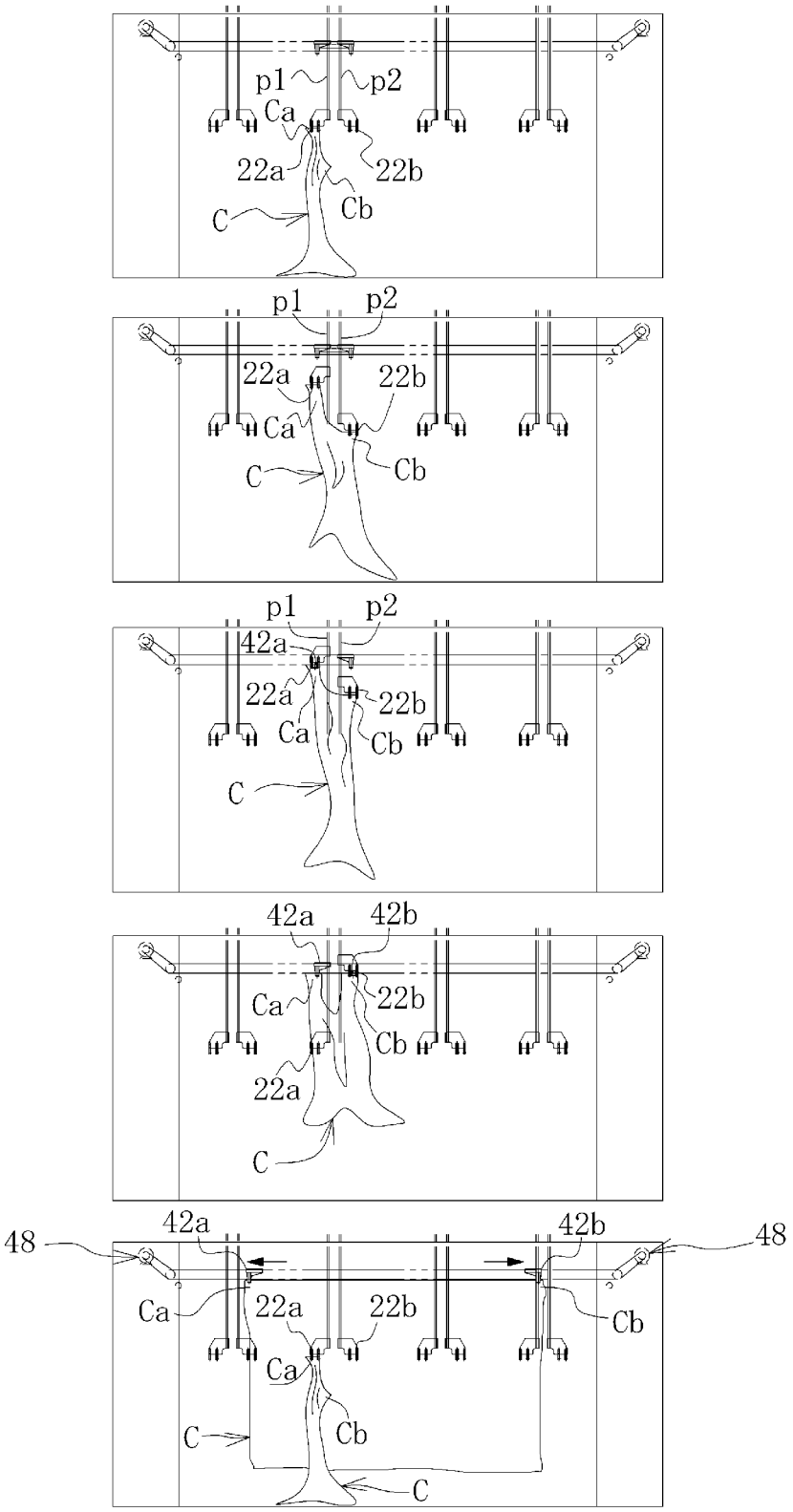
FIG. 4 is a front view sequentially showing steps of spreading a cloth with the cloth spreading apparatus of FIG. 1.

In order to spread the cloth C by using the cloth spreading apparatus 10, as shown in FIG. 4(*a*), a worker first finds one corner Ca of the corners Ca and Cb at both ends in one side of the cloth C, and then the corner Ca is held by the first feeding chuck 22*a* that is on standby at the feeding position.

Figure 5:
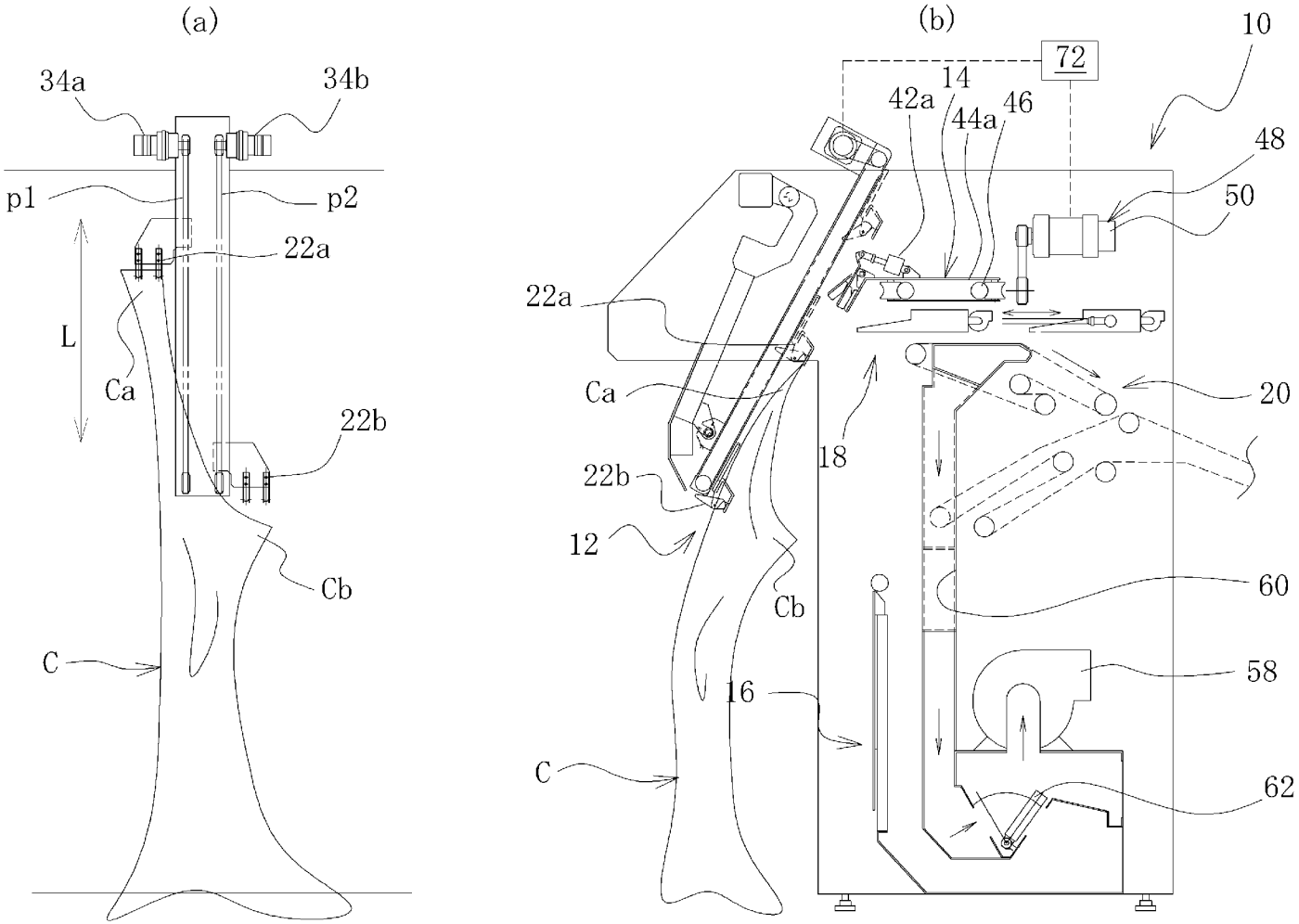
FIG. 5 is a view illustrating a state of lifting upward a first feeding chuck grasping one corner of a cloth by a distance L earlier than a second feeding chuck in the cloth spreading apparatus of FIG. 1, wherein (a) is a front view and (b) is a sectional view.

Next, when the worker presses a switch button (not shown), as shown in FIGS. 5(*a*) and 5(*b*), the first motor 34*a* of the moving device 26 is rotated by the control device 72 in the normal direction to move (raise) the first feeding chuck 22*a* earlier toward the delivery position along the first moving trajectory p1 while holding the corner Ca of the cloth C, and then the rotation of the first motor 34*a* is temporarily stopped at a time of moving by a predetermined distance (earlier moving distance) L.

When the corner Ca of the adjacent corners Ca and Cb of the cloth C is raised earlier by the first feeding chuck 22*a*, the other corner Cb of the cloth C is left in the vicinity of the feeding position, so that the corner Cb can be easily held with the second feeding chuck 22*b* that is on standby at the feeding position by the worker.

Figure 6:
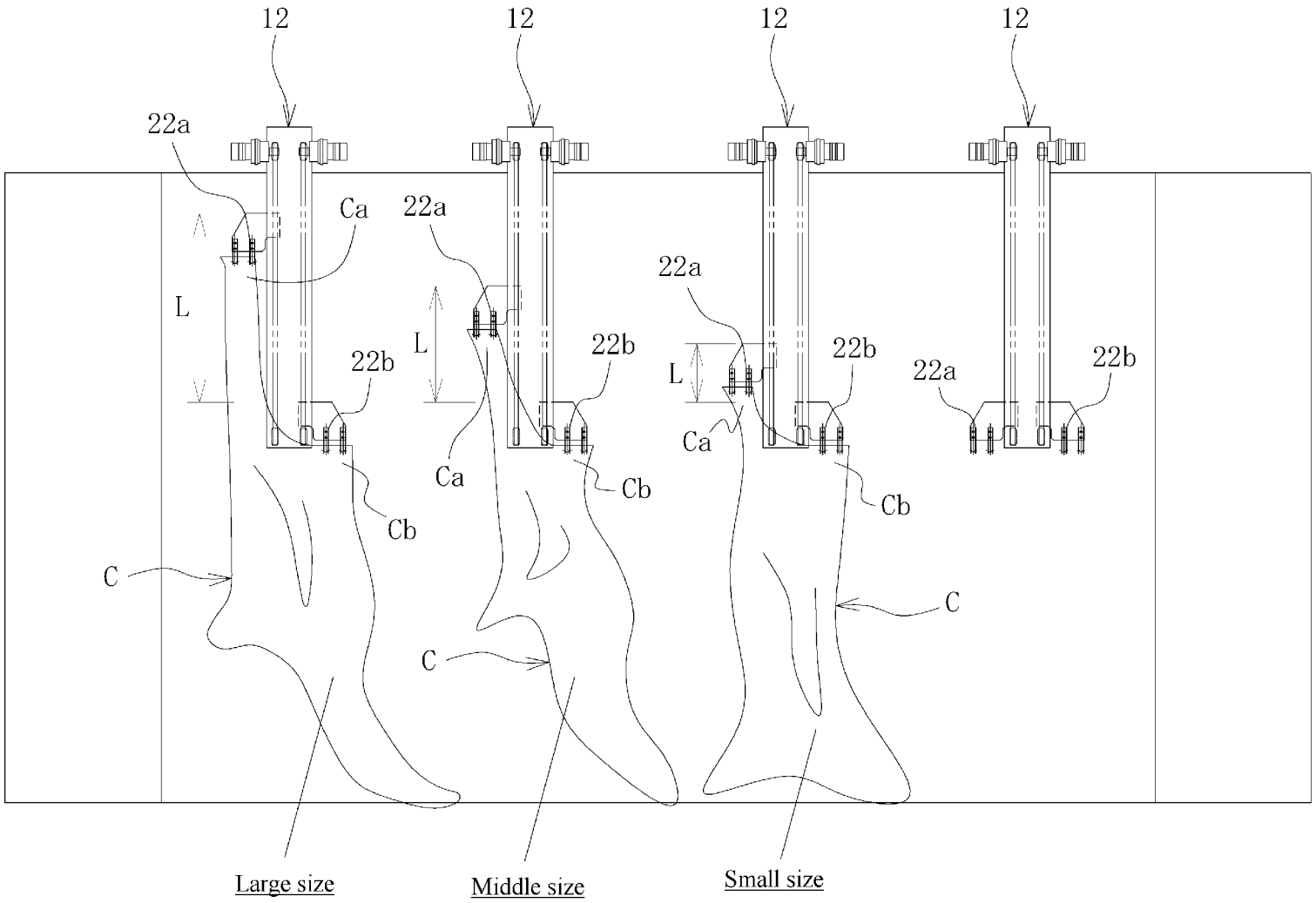
FIG. 6 is a front view showing a use example of feeding a plurality of cloths having different sizes with the cloth spreading apparatus of FIG. 1.

The earlier moving distance L can be arbitrarily preset so as not to exceed the distance between the adjacent corners Ca and Cb of the cloth C (the length of one side of the cloth C). In particular, when feeding plural cloths C having different sizes, it is preferable that a plurality of earlier moving distances L are set stepwise in accordance with the sizes of the cloths C. FIG. 6 shows an example of setting different earlier moving distances L every the feeding unit 12. In the feeding unit 12 on the far left side of the figure, the earlier moving distance L is set to a largest distance to adapt to a large size of cloth C, and the earlier moving distance L is set to a distance smaller than that in the far-left feeding unit 12 to adapt to a middle size of cloth C in the feeding unit 12 located on the right side of the far-left feeding unit 12, and the earlier moving distance L is set to a distance smaller than that in the second feeding unit 12 from the left to adapt to a small size of cloth C in the feeding unit 12 located on the right side of the second feeding unit 12 from the left. Although illustration is omitted, it may be configured that a plurality of earlier moving distances L are set stepwise in the same feeding unit 12 and the earlier moving distance L is changed (selected) every the size change of the cloth C.

Next, referring back to FIG. 4(*b*), when the worker presses a switch button (not shown), the control device 72 rotates the first and second motors 34*a* and 34*b* in the normal direction together to move (raise) the first and second feeding chucks 22*a* and 22*b* toward the spreading chucks 42*a* and 42*b* while holding the upper side of the cloth C. In this case, the moving speed of the first feeding chuck 22*a* and the moving speed of the second feeding chuck 22*b* may be equal, but the moving speed of the second feeding chuck 22*b* may be set to be higher than the moving speed of the first feeding chuck 22*a*.

As shown in FIG. 4(*c*), when the first feeding chuck 22*a* reaches the position of the first spreading chuck 42*a* in the spreading unit 14 (delivery position), the corner Ca of the cloth C held by the first feeding chuck 22*a* is held by the first spreading chuck 42*a* of the spreading unit 14 in the control device 72, and subsequently causes the first feeding chuck 22*a* to release the cloth C. Thus, the corner Ca of the cloth C is delivered from the first feeding chuck 22*a* to the first spreading chuck 42*a*.

Subsequently, the first motor 34*a* is rotated by the control device 72 in the reverse direction to move (descend) the first feeding chuck 22*a* to the original feeding position as shown in FIG. 4(*d*). Thus, the first feeding chuck 22*a* is in a waiting state capable of holding a next cloth C. By that time, the second feeding chuck 22*b* reaches the position of the second spreading chuck 42*b* in the spreading unit 14 (delivery position), so that the second feeding chuck 22*b* and the second spreading chuck 42*b* are controlled in the control device 72 like the case of the first feeding chuck 22*a* to perform delivery of the cloth C from the second feeding chuck 22*b* to the second spreading chuck 42*b*, and thereafter the second motor 34*b* is rotated in the reverse direction to move (descend) the second feeding chuck 22*b* to the original feeding position. Thus, the second feeding chuck 22*b* is also in a waiting state capable of holding the next cloth C.

Next, as shown in FIG. 4(*e*), the traversing device 48 is controlled by the control device 72 to traverse the pair of spreading chucks 42*a* and 42*b* that hold both corners Ca and Cb at the upper side of the cloth C in the horizontal direction separating from each other. Thus, an upper side part of the cloth C is spread in the horizontal direction.

The subsequent actions will be described with reference to FIG. 1. When the flow path switching plate 62 is switched to open the opening of the suction introduction passage 54 in a state of spreading the upper side part of the cloth C with the pair of spreading chucks 42*a* and 42*b*, the cloth C is drawn into the suction introduction passage 54 under negative pressure.

When the flow path switching plate 62 is switched again to close the opening of the suction introduction passage 54, an airflow inside the suction introduction passage 54 is stopped to create a state where the cloth C can be easily pulled up. In this state, a vacuum box 64 in the forwarding unit 18 is advanced into contact with the cloth C, while the chuck portions of the spreading chucks 42*a* and 42*b* are opened and at the same time air is blown, for example, from the front side, whereby the upper end portion of the cloth C is sucked onto the vacuum box 64 in the forwarding unit 18.

Next, an upper portion of the cloth C is pulled onto the primary belt conveyor 66 of the transfer unit 20 while retracting the vacuum box 64. Then, the upper portion of the cloth C is attracted to the conveying surface of the primary belt conveyor 66 by suction force from a vacuum box 70 communicating with a suction fan 58, whereby the cloth C is moved from the forwarding unit 18 to the primary belt conveyor 66.

Subsequently, the cloth C is transferred from the primary belt conveyor 66 to the secondary belt conveyor 68 and discharged to the processing device for the next process.

As mentioned above, according to the cloth spreading apparatus 10 of this embodiment, the first and second feeding chucks 22*a* and 22*b* can be moved between the feeding position and the delivery position independently of each other. The first feeding chuck 22*a* is moved toward the delivery position earlier than the second feeding chuck 22*b* while grasping one corner Ca of the adjacent corners Ca and Cb of the cloth C, whereby the corner Cb of the cloth C to be grasped by the second feeding chuck 22*b* can appear near the feeding position. Thus, the troublesome work for finding the corner Cb by pulling can be eliminated from the worker to obtain excellent feeding efficiency.

According to the cloth spreading apparatus 10 of this embodiment, it is configured that the distance L (earlier moving distance) that the first feeding chuck 22*a* is moved toward the delivery position earlier than the second feeding chuck 22*b* can be arbitrarily set, so that it is possible to easily feed cloth C of different sizes by changing the earlier moving distance L according to the size of the cloth C to be fed.

According to the cloth spreading apparatus 10 of this embodiment, it is configured that the earlier moving distances L can be set stepwise in plural values, so that the earlier moving distance L can be easily changed when feeding different size cloths C.

According to the cloth spreading apparatus 10 of this embodiment, it is configured that the first and second feeding chucks 22*a* and 22*b* move toward the delivery position at a synchronous speed from each other in a state of grasping the cloth C with both of the first and second feeding chucks 22*a* and 22*b*, whereby the relative distance between the first and second feeding chucks 22*a* and 22*b* during the moving can be maintained constantly to prevent application of an unnecessary tensile force to the cloth C during the moving.

Alternatively, it is configured that the second feeding chuck 22*b* move toward the delivery position at a speed faster than the earlier first feeding chuck 22*a* in a state of grasping the cloth C with both of the first feeding chuck 22*a* and second feeding chuck 22*b*, whereby it is made possible not only to prevent application of an unnecessary tensile force to the cloth C during the moving, but also to shorten the time of delivering the cloth C to the spreading unit 14 by the second feeding chuck 22*b* to increase the work efficiency.

According to the cloth spreading apparatus 10 of this embodiment, it is configured that the first feeding chuck 22*a* that departed earlier toward the delivery position performs the delivery of the cloth C to the first spreading chuck 42*a* earlier than the second feeding chuck 22*b* and returns to the original feeding position earlier than the second feeding chuck 22*b* after the completion of the delivery. Thus, it is possible to shorten the time of returning the first feeding chuck 22*a* to the original feeding position to render into a waiting state for feeding the next cloth C, which can increase the work efficiency.

Figure 7:
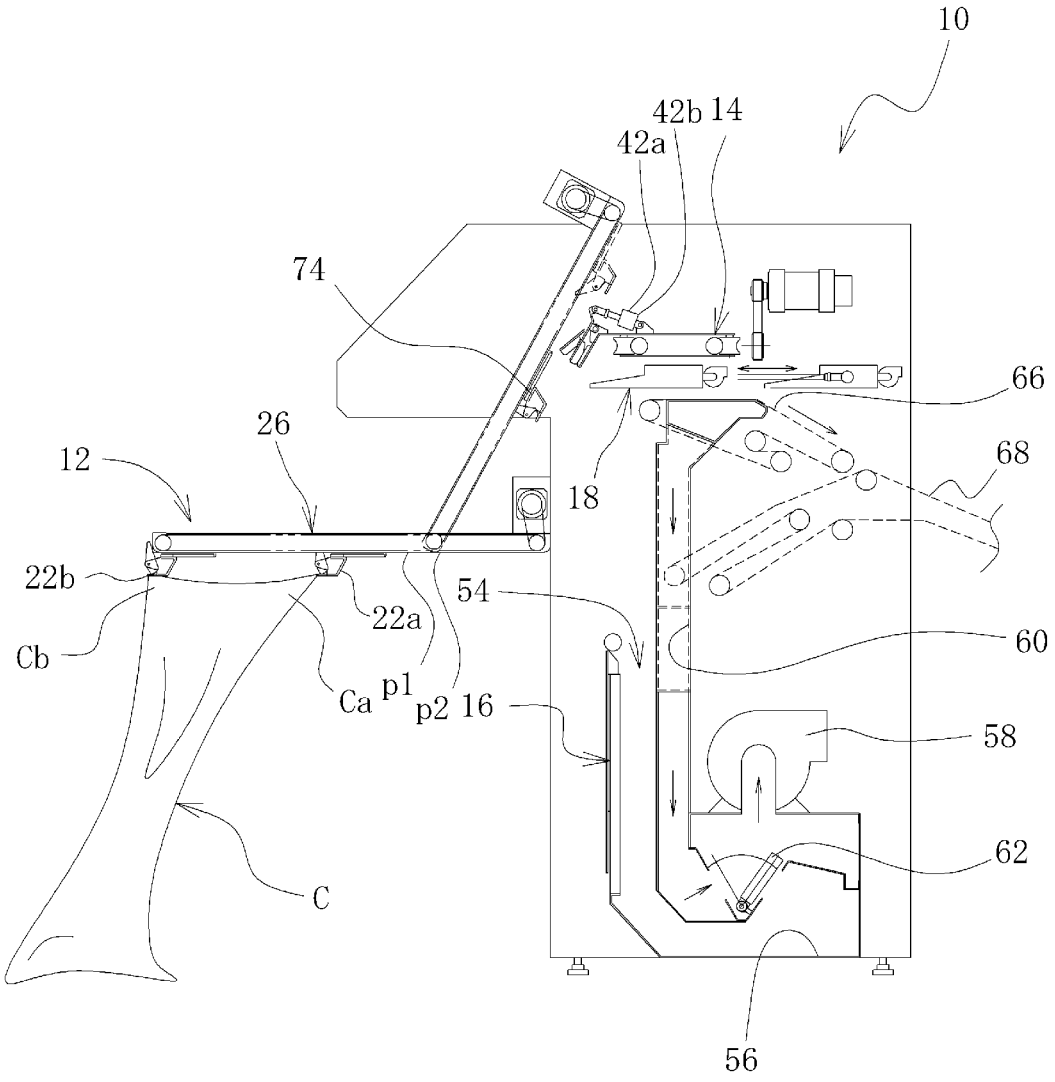
FIG. 7 is a sectional view of a cloth spreading apparatus according to another embodiment of the present invention taken along a front-back direction.
Figure 8:
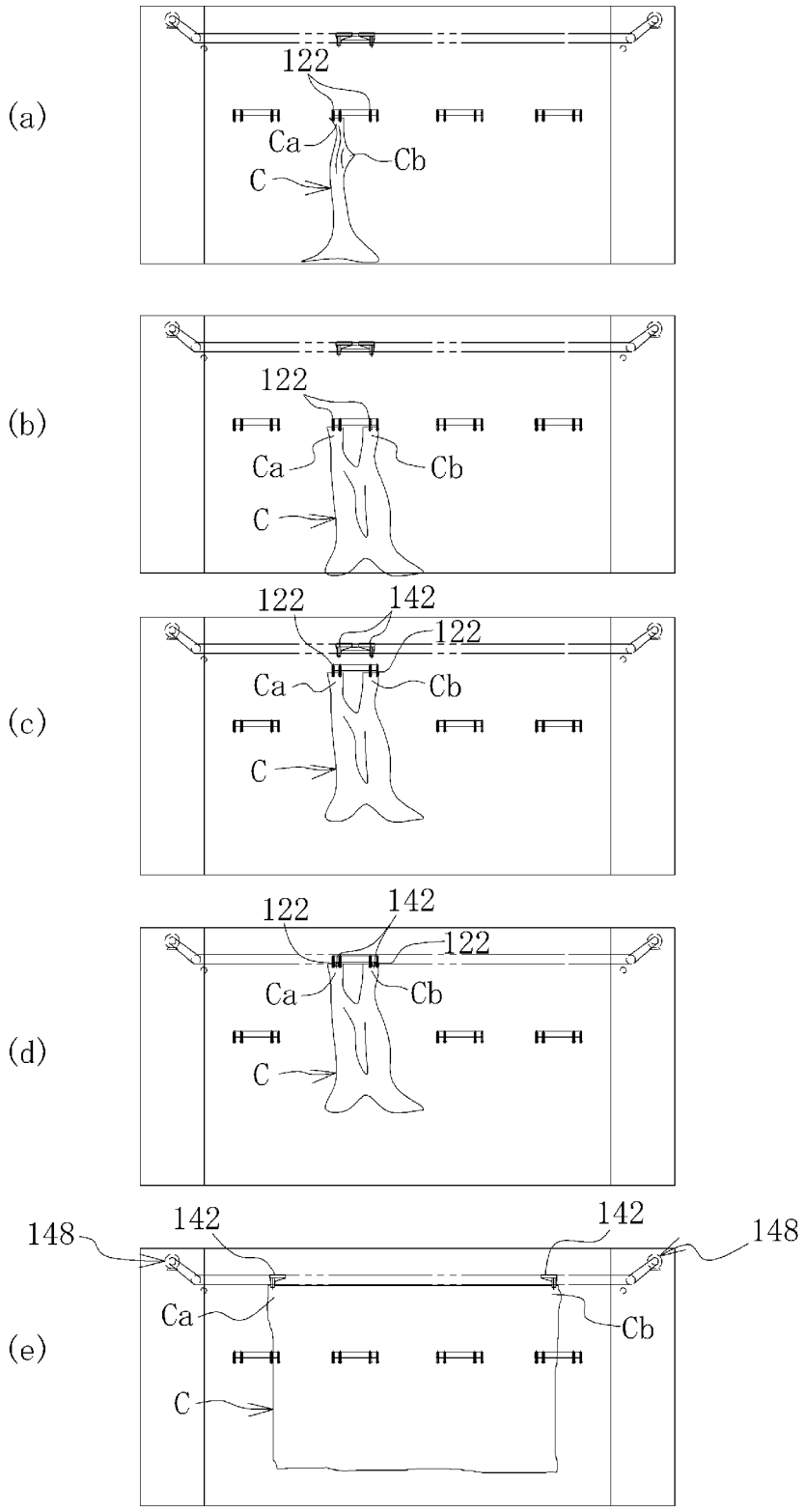
FIG. 8 is a front view sequentially showing steps of spreading a cloth with the conventional cloth spreading apparatus.

The present invention is described based on the illustrated example, but the invention is not limited to this example and can be properly modified within the scope described in the claims. For example, in the cloth spreading apparatus 10 shown in FIG. 1, the first and second moving trajectories p1 and p2 are set to the inclined posture or the vertical posture as seen in side views. However, as shown in FIG. 7, the first and second moving trajectories p1 and p2 may be horizontal as seen in a side view. In this case, a pair of intermediate chucks 74 are provided so as to move up and down between the horizontally traveling first and second feeding chucks 22*a* and 22*b* and the spreading chucks 42*a* and 42*b*, whereby the cloth C may be delivered from the first and second feeding chucks 22*a* and 22*b* to the spreading chucks 42*a* and 42*b* through the pair of intermediate chucks 74.

In the illustrated cloth spreading apparatus 10, the first and second feeding chucks 22*a* and 22*b* are constructed to directly deliver the cloth C to the spreading chucks 42*a* and 42*b*. A waiting chuck (not shown) may be separately provided between the first and second feeding chucks 22*a* and 22*b* and the spreading chucks 42*a* and 42*b*, and the cloth C may be indirectly delivered to the spreading chucks 42*a* and 42*b* through the waiting chuck. In the latter case, even when the spreading work is conducted by the spreading chucks 42*a* and 42*b* and hence the cloth C cannot be received from the first and second feeding chucks 22*a* and 22*b*, the waiting chuck can receive the cloth C to be fed, which can increase the work efficiency.

Also, the separate moving trajectories of the moving device in the present invention include not only a linear trajectory that an outward path and a homeward path are located on the same trajectory, but also an elliptical loop trajectory (cyclic trajectory) that an outward path and a homeward path are located on different trajectories. For example, the first and second feeding chucks 22*a* and 22*b* may be caused to orbit along an elliptical loop track (guide rail) in a direction from the feeding position toward the delivery position instead of reciprocating between the feeding position and the delivery position along a linear track, whereby the feeding chucks 22*a* and 22*b* may be moved from the feeding position to the delivery position and from the delivery position to the feeding position.

INDUSTRIAL APPLICABILITY

According to the cloth spreading apparatus of the present invention, the burden on workers and working hours can be reduced by eliminating the troublesome work of pulling the cloth in the holding of the cloth by the feeding chucks.

REFERENCE SIGNS LIST

10 Cloth spreading apparatus
12 Feeding unit
14 Spreading unit
16 Suction unit
18 Forwarding unit
20 Transfer unit
22*a* First feeding chuck
22*b* Second feeding chuck
26 Moving device
42*a* First spreading chuck
42*b* Second spreading chuck
48 Traversing device
72 Control device
C Cloth
L Earlier moving distance

The invention claimed is:

1. A cloth spreading apparatus comprising:

a pair of feeding chucks for grasping adjacent corners of a cloth;

a moving device for moving the pair of feeding chucks between a feeding position and a delivery position of the cloth to feed the cloth; and a spreading chuck for directly or indirectly receiving the cloth from the pair of feeding chucks and spreading the cloth in a direction of separating the adjacent corners from each other, wherein the moving device has a separate moving trajectory corresponding to each of the feeding chucks and the pair of feeding chucks are constructed so as to move independently of each other between the feeding position and the delivery position.

2. The cloth spreading apparatus according to claim 1, wherein one feeding chuck in the pair of feeding chucks moves toward the delivery position earlier than the other feeding chuck.

3. The cloth spreading apparatus according to claim 2, wherein the pair of feeding chucks move at a synchronous speed to each other toward the delivery position in a state of grasping the cloth with the pair of feeding chucks.

4. The cloth spreading apparatus according to claim 2, wherein the latter feeding chuck that departed later moves toward the delivery position at a speed faster than that of the former feeding chuck that departed earlier in a state of grasping the cloth with the pair of feeding chucks.

5. The cloth spreading apparatus according to claim 2, wherein the former feeding chuck that departed earlier toward the delivery position performs the delivery of the cloth to the spreading chuck earlier than the latter feeding chuck that departed later, and returns to an original feeding position earlier than the latter feeding chuck after the completion of the delivery.

6. The cloth spreading apparatus according to claim 2, wherein a distance that the former feeding chuck moves toward the delivery position earlier than the latter feeding chuck can be set arbitrarily.

7. The cloth spreading apparatus according to claim 6, wherein the distance that the former feeding chuck moves toward the delivery position earlier than the latter feeding chuck can be set stepwise.

8. The cloth spreading apparatus according to claim 7, wherein the pair of feeding chucks move at a synchronous speed to each other toward the delivery position in a state of grasping the cloth with the pair of feeding chucks.

9. The cloth spreading apparatus according to claim 6, wherein the pair of feeding chucks move at a synchronous speed to each other toward the delivery position in a state of grasping the cloth with the pair of feeding chucks.

10. The cloth spreading apparatus according to claim 6, wherein the latter feeding chuck that departed later moves toward the delivery position at a speed faster than that of the former feeding chuck that departed earlier in a state of grasping the cloth with the pair of feeding chucks.

11. The cloth spreading apparatus according to claim 6, wherein the former feeding chuck that departed earlier toward the delivery position performs the delivery of the cloth to the spreading chuck earlier than the latter feeding chuck that departed later, and returns to an original feeding position earlier than the latter feeding chuck after the completion of the delivery.

12. The cloth spreading apparatus according to claim 2, wherein the distance that the former feeding chuck moves toward the delivery position earlier than the latter feeding chuck can be set stepwise.

13. The cloth spreading apparatus according to claim 12, wherein the pair of feeding chucks move at a synchronous speed to each other toward the delivery position in a state of grasping the cloth with the pair of feeding chucks.

14. The cloth spreading apparatus according to claim 12, wherein the latter feeding chuck that departed later moves toward the delivery position at a speed faster than that of the former feeding chuck that departed earlier in a state of grasping the cloth with the pair of feeding chucks.

15. The cloth spreading apparatus according to claim 1, wherein the pair of feeding chucks move at a synchronous speed to each other toward the delivery position in a state of grasping the cloth with the pair of feeding chucks.

16. The cloth spreading apparatus according to claim 15, wherein the latter feeding chuck that departed later moves toward the delivery position at a speed faster than that of the former feeding chuck that departed earlier in a state of grasping the cloth with the pair of feeding chucks.

17. The cloth spreading apparatus according to claim 15, wherein the former feeding chuck that departed earlier toward the delivery position performs the delivery of the cloth to the spreading chuck earlier than the latter feeding chuck that departed later, and returns to an original feeding position earlier than the latter feeding chuck after the completion of the delivery.

18. The cloth spreading apparatus according to claim 1, wherein the latter feeding chuck that departed later moves toward the delivery position at a speed faster than that of the former feeding chuck that departed earlier in a state of grasping the cloth with the pair of feeding chucks.

19. The cloth spreading apparatus according to claim 18, wherein the former feeding chuck that departed earlier toward the delivery position performs the delivery of the cloth to the spreading chuck earlier than the latter feeding chuck that departed later, and returns to an original feeding position earlier than the latter feeding chuck after the completion of the delivery.

20. The cloth spreading apparatus according to claim 1, wherein the former feeding chuck that departed earlier toward the delivery position performs the delivery of the cloth to the spreading chuck earlier than the latter feeding chuck that departed later, and returns to an original feeding position earlier than the latter feeding chuck after the completion of the delivery.

* * * * *